US005997647A

United States Patent [19]

McGuffie

[11] Patent Number: 5,997,647

[45] Date of Patent: Dec. 7, 1999

[54] ADJUSTABLE LINE MARKING APPARATUS

[76] Inventor: Iain Peter McGuffie, Hungry Hill Farm, Stoke Lacy, Nr Bromyard, Herefordshire HR7 4HD, United Kingdom

[21] Appl. No.: 09/070,654

[22] Filed: Apr. 30, 1998

[30] Foreign Application Priority Data

May 17, 1997 [GB] United Kingdom ..... 9709947

[51] Int. Cl.[6] ..... E01C 23/16; B05D 1/32; B05B 15/04; B05C 1/16

[52] U.S. Cl. ..... 118/504; 404/94; 427/137; 427/282; 118/301; 118/305

[58] Field of Search ..... 118/301, 305, 118/323, 504, 505; 222/611.1; 427/282, 286, 136, 137; 404/93, 94

[56] References Cited

U.S. PATENT DOCUMENTS 2,338,894 1/1944 Beebe ..... 91/12

4,053,108 10/1977 Hofmann ..... 239/150

*Primary Examiner*—Shrive Beck
*Assistant Examiner*—Jennifer Calcagni
*Attorney, Agent, or Firm*—Ira S. Dorman

[57] ABSTRACT

A line marking apparatus adapted in use to be advanced relative to a ground surface in a line marking direction includes a discharge opening region formed between first and second side members for discharge of line marking material therebetween onto the ground surface. The side members extend substantially parallel to the line marking direction and adjusting means is provided for moving the first and second side members towards and away from each other so as to adjust the width of a line to be marked by the apparatus. The adjusting means comprises interconnected pivotable arms, at least one of the side members being supported on the pivotable arms such that relative pivoting of the arms causes the at least one of the side members to move towards and away from the other thereof.

22 Claims, 3 Drawing Sheets

ADJUSTABLE LINE MARKING APPARATUS

This invention relates to an adjustable line marking apparatus which is advanced relative to a ground surface in a line marking direction to mark lines onto the ground surface in the line marking direction.

DESCRIPTION OF PRIOR ART

Line marking apparatus in the form of line marking shoes are principally, but not exclusively, advanced over the ground surface in the line marking direction by suitable supporting apparatus and comprise two spaced side walls defining a discharge opening region to produce a line of predetermined width on the ground surface.

It is known from International Patent Application No. PCT/GB96/02323 to provide in the discharge opening region a plurality of discharge opening areas which are so dimensioned and disposed that discharge of line marking material through different discharge opening areas produces lines of different predetermined widths. While this arrangement does enable lines having several alternative widths to be marked, the range of widths is inevitably determined by the specific widths provided in the discharge opening region with the result that the line width required may not be available.

OBJECT OF THE INVENTION

It is therefore an object of the present invention to provide an adjustable line marking apparatus which is able to provide any required line width from a predetermined minimum line width to a predetermined maximum line width.

SUMMARY OF THE INVENTION

According to the present invention there is provided a line marking apparatus adapted in use to be advanced relative to a ground surface in a line marking direction, the line marking apparatus comprising a discharge opening region formed between first and second side members for discharge of line marking material therebetween onto the ground surface, the side members extending substantially parallel to the line marking direction, and adjusting means for moving the first and second side members towards and away from each other so as to adjust the width of a line to be marked by the apparatus, wherein the adjusting means comprises a plurality of interconnected pivotable arms, at least one of the side members being supported on the pivotable arms such that relative pivoting of the arms causes the at least one of the side members to move towards and away from the other thereof.

Thus, only one of the side members may be mounted on the pivotable arms or both side members may be so mounted.

The pivotable arms may be interconnected in the configuration of a polygon such that vertices of the polygon are movable towards and away from each other.

Four pivotable arms may be provided interconnected in the configuration of a parallelogram, such as in the form of a rhombus. The arrangement may be such that opposed vertices of the parallelogram are movable towards and away from each other. The side members may be supported on the pivotable arms by means intermediate the ends of each of the arms such that one adjoining pair of arms supports the first side member and the other adjoining pair of arms supports the second side member.

Each side member may be provided with means for engaging at least one of the respective pair of arms intermediate the ends of the arm in a manner which permits relative movement between the side member and the arm in the longitudinal direction of the side member. The relative movement may be sliding movement, for example in an elongate aperture provided in the side member. Each side member may be pivotably connected to one of the respective pair of arms intermediate the ends thereof.

The vertices of one pair of opposed vertices may be movable towards and away from each other in a substantially straight line. The straight line may be substantially parallel to the line marking direction or may be substantially transverse to the line marking direction. One of the vertices of the one pair may be stationary with the other of the vertices of the one pair movable towards and away from the said one vertex. The or each movable vertex of the one pair may be releasably secured in position. Graduation means may be provided relative to the or each movable vertex for determining the spacing between the side members. The or each movable vertex may be guided by means received in an elongate aperture formed in a support plate. The or each movable vertex may incorporate a clamping member, for example engageable and disengageable with the support plate.

The line marking apparatus may incorporate a curved sole plate for contacting the ground surface.

For a better understanding of the present invention and to show more clearly how it may be carried into effect reference will now be made, by way of example, to the accompanying drawings in which:

DESCRIPTION OF PREFERRED EMBODIMENT

Figure 1:
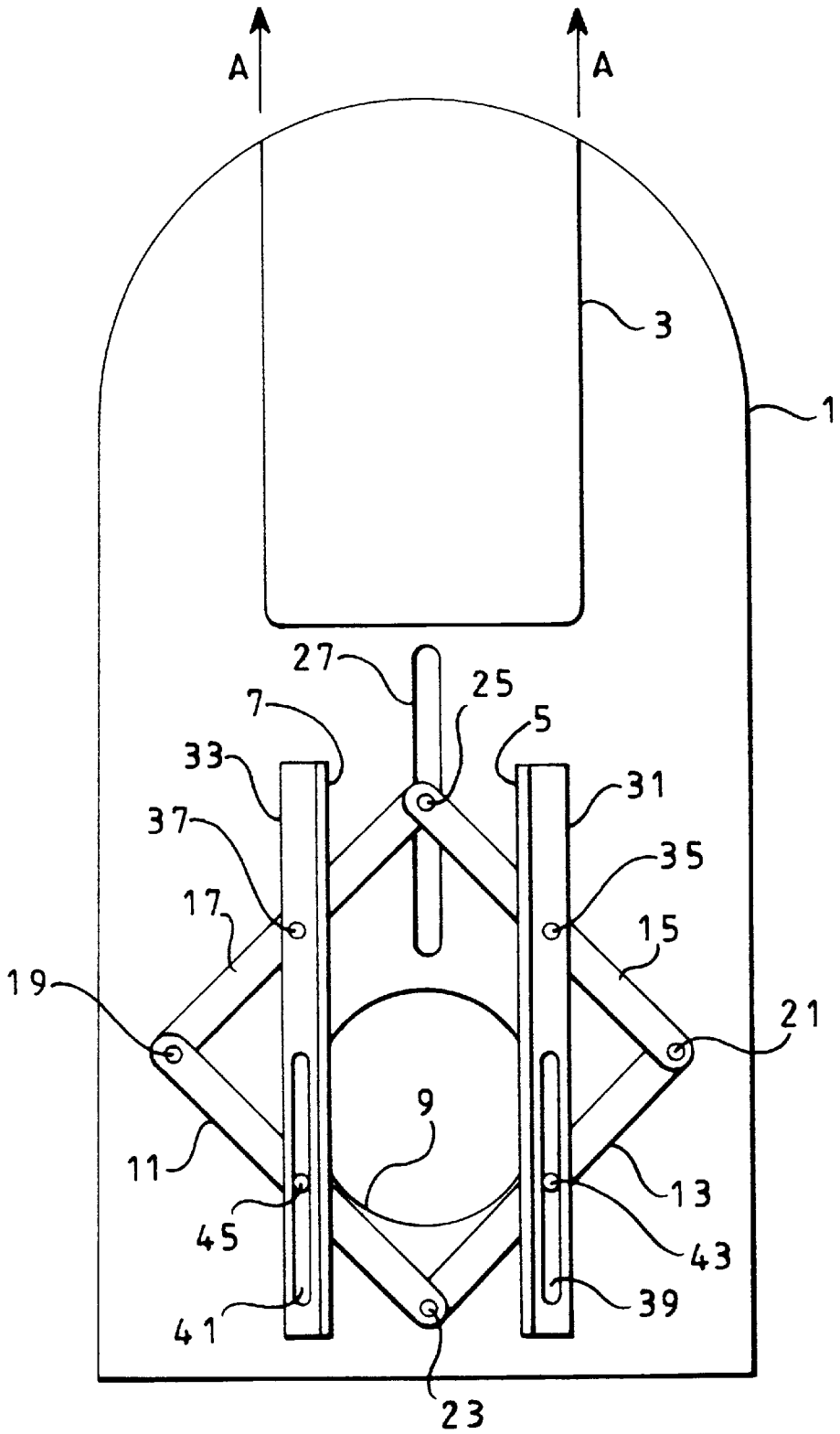
FIG. 1 is a plan view from beneath of part of one embodiment of a line marking apparatus according to the present invention.
Figure 2:
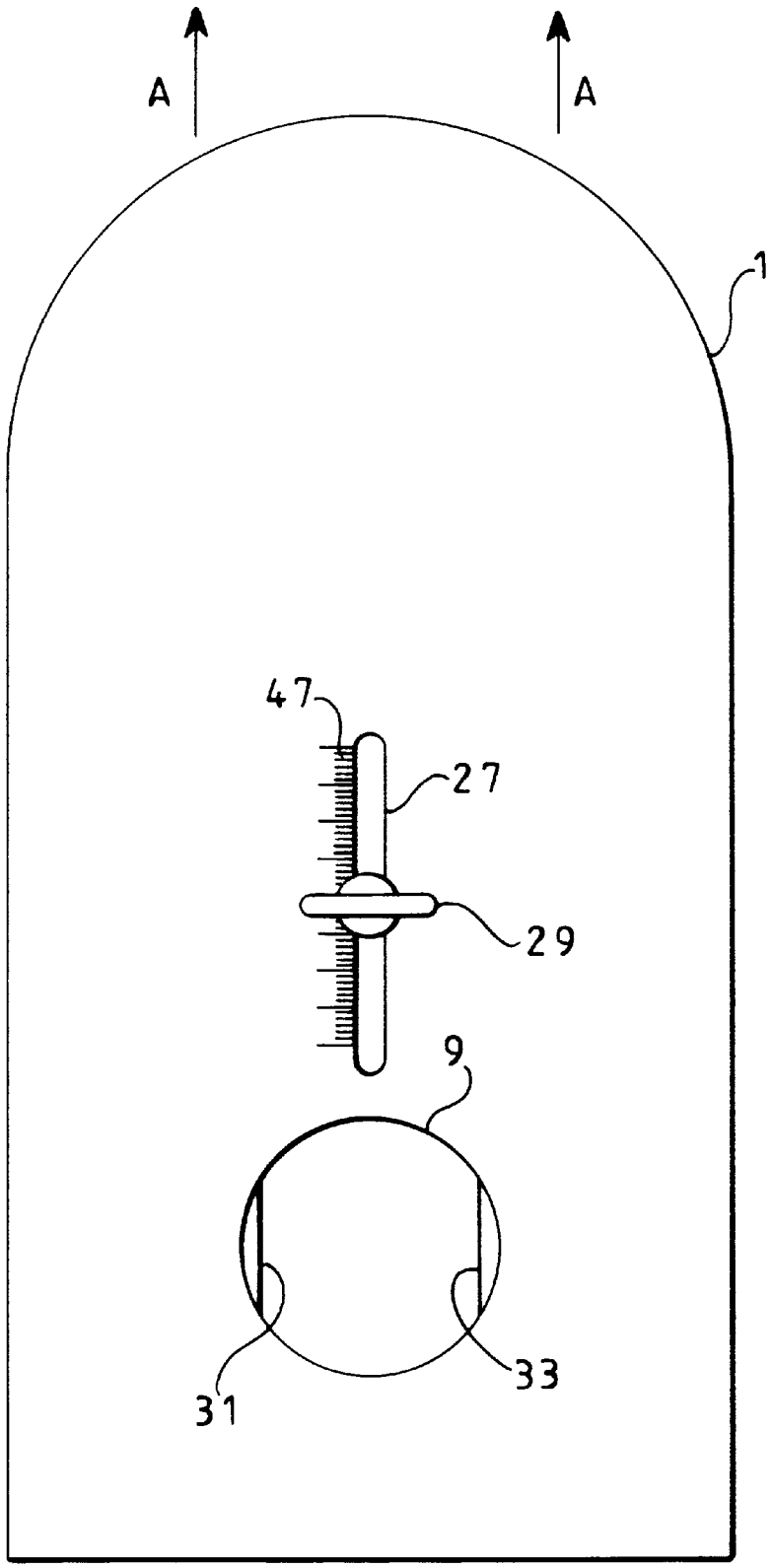
FIG. 2 is a plan view from above of the part of the line marking apparatus shown in FIG. 1.
Figure 3:
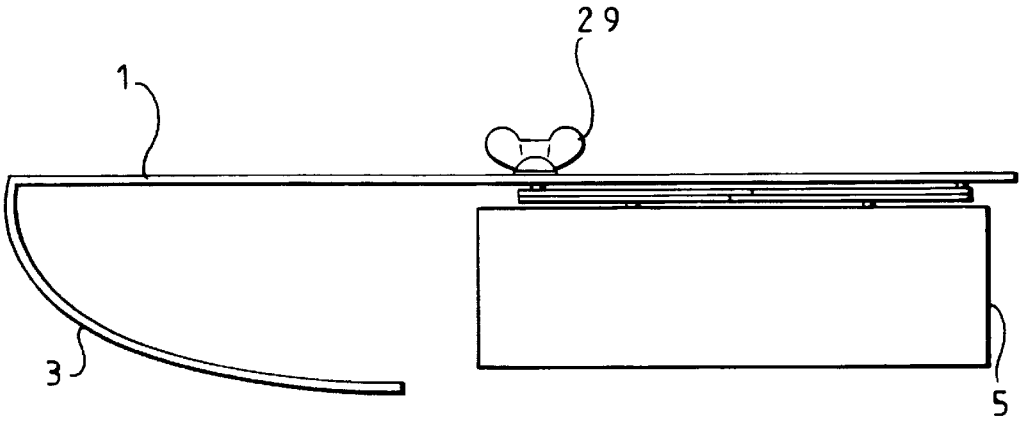
FIG. 3 is a side elevational view of the line marking apparatus shown in FIGS. 1 and 2.

FIGS. 1, 2 and 3 show a line marking apparatus in the form of a line marking shoe comprising a generally horizontal support plate 1 to the forward end region of which is secured a curved sole plate 3 (see FIG. 3) which in use contacts a ground surface to be marked with a line and moves over the ground surface in a line marking direction A. As can be seen from FIG. 3, to facilitate movement of the shoe over the ground surface the forward end of the sole plate 3 is curved upwardly away from the ground surface.

Mounted beneath the support plate 1 are two spaced apart upright side plates 5 and 7 which extend substantially parallel to each other to define a guide channel therebetween and which extend substantially parallel to the line marking direction A. The side plates 5 and 7 are mounted on an adjusting mechanism which will be described in more detail hereinafter.

An aperture 9 is provided through the support plate 1 intermediate the side plates 5 and 7 so as to receive a spray nozzle (not shown) for spraying line marking liquid intermediate the side walls and to create a line on the ground surface having a width corresponding substantially to the spacing between the side walls. The form of the spray nozzle and the manner in which it is provided with marking liquid are well known to the skilled person and require no further explanation herein.

The adjusting mechanism comprises four arms 11, 13, 15 and 17 of substantially equal length and pivotably interconnected at each end thereof to form a rhombus. Thus the arms 11 and 17 are pivotably interconnected at pivot point 19 and the arms 13 and 15 are pivotably interconnected at pivot point 21. Arms 11 and 13 are pivotably interconnected at pivot point 23 with pivot point 23 being secured to the support plate 1. Arms 15 and 17 are pivotably interconnected at pivot point 25 which extends through an elongate aperture 27 formed in the support plate 1 and has threadedly mounted thereon a clamping member 29 such as a wing nut or other rotatable clamping member which is engageable and disengageable with the support plate 1 for releasably clamping the adjusting mechanism to the support plate in the region of the pivot point 25. The elongate aperture 27 extends substantially in the line marking direction A and the pivot points 23 and 25 are substantially collinear with the axis of the elongate aperture 27.

It should be noted that the clamping member 29 could be operable remotely, for example from handle means of the line marking apparatus, such as by way of a cable.

Thus far described, the adjusting mechanism can be moved with the clamping member 29 disengaged from the support plate 1 such that the pivot point 25 can be positioned at either end of the elongate aperture 27 or at any chosen position intermediate the ends thereof. When the pivot point 25 is in the desired location the clamping member 29 can be engaged with the support plate 1 to inhibit further movement. Subsequent adjustment of the position of the pivot point 25 can simply be effected by releasing the clamping member 29, repositioning the pivot point 25 and re-engaging the clamping member. When the pivot point 25 is at that end of the elongate aperture 27 closest to the pivot point 23, the pivot points 19 and 21 are spaced a significant distance apart. However, as the pivot point 25 is moved away from the pivot point 23, the pivot points 19 and 21 move progressively closer together.

The side plates 5 and 7 are each provided with a laterally outwardly extending guide member 31 and 33, respectively.

One end of the guide members 31 and 33, the forward end as shown in FIGS. 1 and 3, is pivotably mounted on a respective one of the pivotable arms 15 and 17, with the guide member 31 being pivotably mounted on the arm 15 by way of a pivot point 35 and the guide member 33 being pivotably mounted on the arm 17 by way of a pivot point 37. The pivot points 35 and 37 are positioned intermediate the ends of the arms 15 and 17, with the relative position being equivalent for each arm.

The other end of the guide members 31 and 33 is formed with an elongate slot 39 and 41 respectively with the slot 39 being slidably retained on the arm 13 by retaining member 43 and the slot 41 being slidably retained on the arm 11 by retaining member 45. The retaining members 43 and 45 are positioned intermediate the ends of the arms 13 and 11, with the relative position being equivalent for each arm and being substantially the same as for the pivot points 35 and 37.

Thus the side plates 5 and 7 are mounted on the adjusting mechanism in such a way that they are substantially parallel to each other and are substantially parallel to the line marking direction A.

The side plates 5 and 7 are therefore mounted in such a way that, as the pivot points 19 and 21 move apart, the side plates 5 and 7 also move apart while at the same time remaining substantially parallel to each other and substantially parallel to the line marking direction A. Contrariwise, as the pivot points 19 and 21 move together, the side plates 5 and 7 also move together while at the same time remaining substantially parallel to each other and substantially parallel to the line marking direction A.

Consequently, the spacing between the side plates 5 and 7 can be adjusted manually by an operator in a simple manner by moving the clamping member 29 to a desired position along the length of the elongate slot 27 and by engaging the clamping member with the support plate 1 so as to secure the adjusting mechanism in a predetermined position. A scale 47 indicative of the spacing between the side plates 5 and 7, and therefore indicative of the width of the line to be marked, may be provided on the upper side of the support plate 1 as shown in FIG. 2.

Clearly, numerous modifications can be made to the embodiment of the invention illustrated in FIGS. 1 to 3 without departing from the scope of the invention.

Figure 4:
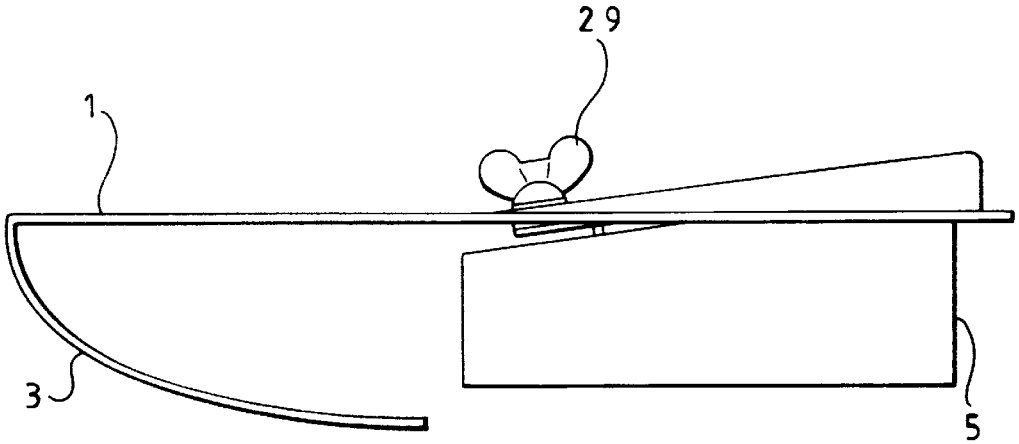
FIG. 4 is a side elevational view of a modified form of support plate for use in a line marking apparatus according to the present invention.

For example, the support plate 1 may be profiled as illustrated in FIG. 4. According to the embodiment of FIG. 4, the support plate 1 is curved upwardly so that the side plates are in a low configuration relative to the ground surface when the spacing therebetween is relatively small and so that the side plates are in an elevated configuration relative to the ground when the spacing therebetween is relatively large.

Clearly, the fixed and movable pivot points 23 and 25 could be interchanged in the line marking direction as could be the pivot points 35 and 37 and the respective elongate slots 39 and 41. Indeed, the elongate slots 39 and 41 could be replaced by an alternative configuration which permits movement between the arms 11 and 13 and the side plates 5 and 7 in a direction substantially parallel to the line marking direction, such as an elongate recess in place of an elongate slot.

For added support, the pivot points 19 and 21 may be supported by the support plate 1 in a manner which permits arcuate movement of the pivot points 19 and 21 as the pivot point 25 is adjusted.

The illustrated embodiment has the advantage that the pivot points 23 and 25 are not displaceable laterally relative to the line marking direction A, but an alternative embodiment could secure one of the pivot points 19 and 21 and allow the other to be movable in a direction transverse to the line marking direction. Such an arrangement would permit adjustment of the line width, but would suffer the disadvantage that adjustment of the line width would result in the mid-point of the marked line being displaced laterally of the line marking direction.

I claim:

1. A line marking apparatus adapted in use to be advanced relative to a ground surface in a line marking direction, the line marking apparatus comprising a discharge opening region formed between first and second side members for discharge of line marking material therebetween onto the ground surface, the side members extending substantially parallel to the line marking direction, and adjusting means for moving the first and second side members towards and away from each other so as to adjust the width of a line to be marked by the apparatus, wherein the adjusting means comprises a plurality of interconnected pivotable arms, at least one of the side members being supported on the pivotable arms such that relative pivoting of the arms causes the at least one of the side members to move towards and away from the other thereof.

2. An apparatus according to claim 1, wherein one of the first and second side members is mounted on the pivotable arms.

3. An apparatus according to claim 1, wherein both the first and second side members are mounted on the pivotable arms.

4. An apparatus according to claim 1, wherein the pivotable arms are interconnected in the configuration of a polygon such that vertices of the polygon are movable towards and away from each other.

5. An apparatus according to claim 4, wherein four pivotable arms are provided interconnected in the configuration of a parallelogram.

6. An apparatus according to claim 5, wherein the pivotable arms are connected in the form of a rhombus.

7. An apparatus according to claim 5, wherein opposed vertices of the parallelogram are movable towards and away from each other.

8. An apparatus according to claim 7, wherein the side members are supported on the pivotable arms by means intermediate the ends of each of the arms such that one adjoining pair of arms supports the first side member and the other adjoining pair of arms supports the second side member.

9. An apparatus according to claim 8, wherein each side member is provided with means for engaging at least one of the respective pair of arms intermediate the ends of the arm in a manner which permits relative movement between the side member and the arm in the longitudinal direction of the side member.

10. An apparatus according to claim 9, wherein the relative movement is sliding movement.

11. An apparatus according to claim 10, wherein the sliding movement is effected in an elongate aperture provided in the side member.

12. An apparatus according to claim 8, wherein each side member is pivotably connected to one of the respective pair of arms intermediate the ends thereof.

13. An apparatus according to claim 7, wherein the vertices of one pair of opposed vertices are movable towards and away from each other in a substantially straight line.

14. An apparatus according to claim 13, wherein the straight line is substantially parallel to the line marking direction.

15. An apparatus according to claim 13, wherein the straight line is substantially transverse to the line marking direction.

16. An apparatus according to claim 7, wherein one of the vertices of the one pair is stationary with the other of the vertices of the one pair being movable towards and away from the said one vertex.

17. An apparatus according to claim 4, wherein the or each movable vertex of the one pair is releasably secured in position.

18. An apparatus according to claim 17, wherein the or each movable vertex incorporates a clamping member.

19. An apparatus according to claim 18, wherein the clamping member is engageable and disengageable with a support plate.

20. An apparatus according to claim 4, wherein graduation means is provided relative to the or each movable vertex for determining the spacing between the side members.

21. An apparatus according to claim 4, wherein the or each movable vertex is guided by means received in an elongate aperture formed in a support plate.

22. An apparatus according to claim 1 and including a curved sole plate for contacting the ground surface.

* * * * *